United States Patent [19]

Lefevre et al.

[11] Patent Number: 4,593,666

[45] Date of Patent: Jun. 10, 1986

[54] ADAPTIVE PROCESS FOR CONTROLLING FUEL INJECTION IN AN ENGINE

[75] Inventors: Rémi Lefevre, Colombes; Jean-Pierre Lagrue, Palaiseau, both of France

[73] Assignee: Regie Nationale des Usines Renault, Boulogne-Billancourt, France

[21] Appl. No.: 757,665

[22] Filed: Jul. 22, 1985

[30] Foreign Application Priority Data

Jul. 23, 1984 [FR] France ..... 84 11668

[51] Int. Cl.[4] ..... F02B 3/00

[52] U.S. Cl. ..... 123/480; 123/478

[58] Field of Search ..... 123/480, 486, 478

[56] References Cited

U.S. PATENT DOCUMENTS 3,964,443 6/1976 Hartford ..... 123/486

4,250,858 2/1981 Jeenicke ..... 123/486

4,375,209 3/1983 Sinniger ..... 123/486

*Primary Examiner*—Ronald B. Cox

*Attorney, Agent, or Firm*—Oblon, Fisher, Spivak, McClelland & Maier

[57] ABSTRACT

An adaptive process controlling the injection of an engine. The injection time is continuously determined by a standard control as a function of the intake pressure or air flow of the intake. From a straight control line defined by its slope and its beginning ordinate, readjustments are periodically made, by successive adaptive cycles of the values of the slope and the beginning ordinate of the straight control line as a function of the possible richness difference found by an exhaust gas analysis probe.

4 Claims, 2 Drawing Figures

ADAPTIVE PROCESS FOR CONTROLLING FUEL INJECTION IN AN ENGINE

BACKGROUND OF THE INVENTION

1. Field of the Invention

The invention relates generally to the control of fuel injection in an internal combustion engine and more particularly to the precise control of fuel injection in an internal combustion engine by analysis of the exhaust gases.

2. Discussion of Background

It is known how to continuously determine the injection time of an engine using a prior art control device where the injection time is a function of the pressure in the intake manifold or of the air flow at the intake. The determination is made from a straight control line defined by its slope and its ordinate at the beginning in the injection time diagram as a function of the pressure. These values are computed, at most, only during the period of engine tune up. But it is known that they can vary randomly over time as a function of various parameters, for example, clogging of the air filter which reduces the air flow for the same pressure. Therefore, it is necessary for a precise control to readjust the parameters of this straight control line periodically.

For this purpose, there is a process, called the "American process," described particularly in the article "A Closed-Loop A/F Control Model for Internal Combustion Engines" by Douglas R. Hambourg and Michael A. Shulman, published in 1980 by the "Society of Automotive Engineers, Inc." This process consists in using a probe called a "lambda probe" for analysis of the exhaust gases. The probe gives a signal which varies when there is a lack of oxygen in the exhaust gases, showing a richness exceeding value 1 (corresponding to a stoichiometric mixture). When this happens, the parameters of the straight control line are corrected as follows: if the pressure P at the intake is less than a determined threshold, a correction is applied only on the ordinate at the beginning of the straight line, while if the value of the pressure is greater than this threshold, a correction is applied only on the slope of the straight line. This process therefore is approximate. Actually, if existing conditions are maintained, the recomputed straight line always ends up going through the existing operating point, but a local anomaly can falsify the computation of all other points. Further, this process functions only with a unity richness, while problems of fuel saving and pollution are increasingly leading to using richnesses less than unity.

There is also known a process called "superinjection," described in French patent application No. 83 17 538 in the name of the present applicant, and which consists, when the injection is controlled at a richness less than unity, in periodically making a progressive increase of the richness until triggering of the gas analysis probe is obtained, then in coming back to the initial richness while maintaining the value of the relative increase of the injection time which was thus necessary. This, compared with the theoretical increase resulting from the desired richness, gives the necessary correction. The above mentioned patent application indicates how it is possible to avoid jerks resulting from this momentary incursion in richness by controlling the ignition advance. However, these superinjections should be sufficiently spaced in time, with a period, for example, of 10 minutes.

It would, of course, be possible, using the prior art processes, to consider combining the American process, even with a richness less than 1, with the superinjection process. However, in this case, the lack of precision of the American process would be increased more by the considerable increase of the readjustment period due to the superinjection process.

SUMMARY OF THE INVENTION

Accordingly, one object of this invention is to provide a novel process for controlling the fuel injection in an internal combustion engine.

Another object of this invention is to provide a novel adaption process for controlling the injection in an internal combustion engine by analysis of exhaust gases.

A further object of this invention is to provide a novel adaptive process for controlling the fuel injection in an engine by continuously determining the injection time as a function of intake pressure or intake air flow.

A still further object of this invention is to provide a novel adaptive process for controlling fuel injection in an engine whose adaptation is more precise and less sensitive to localized anomalies.

Briefly, these and other objects of the invention are achieved by dividing the space of the usable pressures into a certain number, n of zones, and in assigning to each zone j the central pressure $P_j$ of the zone, the n values of $P_j$ being stored in a read-only memory. Then, periodically, using any periodicity determined in advance, performing the following operation cycle:

Intake pressure P is measured and the number j of the zone in which it is located is computed by complete or rounded off division.

Starting from the indications of an exhaust gas analysis probe and of the desired richness, a correction factor $\alpha$ is determined in relation to the existing straight line such as the correct functioning point at the abscissa or in the relation to $(1+\alpha)$ with the corresponding point of the existing straight line.

Then there is computed, for the index j under consideration, the value of correction factor $\beta$ in relation to the initial straight line, whose parameters are in the read-only memory, with a simple linear formula as a function of the coefficients in the read-only memory and of parameters in read-write memory, and the new computed value is assigned to variable $\beta_j$ in read-write memory.

Finally, as a function of the various values of $\beta$ that are in memory, the new values of the slope and of the ordinate at the beginning of the control straight line are computed with linear formulas bringing into play only weighting constants in the read-only memory.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE PREFERRED EMBODIMENTS

When the engine is running and has a speed greater than that of idling, the injection time $T_i$ is continuously determined by a standard control device as a function of the intake pressure P, or in certain cases, of the air flow at the intake measured by a flow meter. Starting from a straight control line the time can be expressed by the equation:

$$T_i = a \cdot P + b$$

where $$a = (1 + c/256)(1 + c'/256)(\ldots)(1 + f/256)$$

c, c' . . . being corrections which are function of measured parameters, such as water temperature, air temperature, etc. and f being the scale coefficient. The denominators 256 are arbitrary values preferably corresponding to the storage capacity of an eight-bit byte so that small correction values are brought to whole values. The values f and b can be considered as representing, respectively, the slope and ordinate at the beginning of the straight control line, other corrections not being taken into account.

Since the control process is adaptive, values f and b are periodically readjusted as a function of the richness differences found by an exhaust gas analysis probe. It can be a lambda probe with zirconium oxide sensitive to excess oxygen, or any other probe or analysis process.

If the engine operates with unit richness, i.e., a stoichiometric mixture, according to the standards most frequently in use in the United States, the signal of the probe indicates immediately if it is necessary to increase or reduce the richness, i.e., the injection time.

If, on the contrary, the engine operates with a constant or variable richness depending on the circumstances but less than unity, for example 0.8, as is increasingly more frequent the practice according to European standards to reduce consumption and pollution, the value of the correction is slightly more complex to make. In particular, it is possible to use the process known as superinjection. This is described in the abovementioned French patent application and consists, at each adaptation cycle, in progressively increasing the injection time until the output of the analysis probe changes, then in quickly coming back to the preceding richness. If, for example, the richness is set at 0.8, it is sufficient, starting from the existing injection time, to increase the time 25% theoretically to obtain this change. When this change occurs, a simple rule of three gives the value of the correction to be made.

Figure 1:
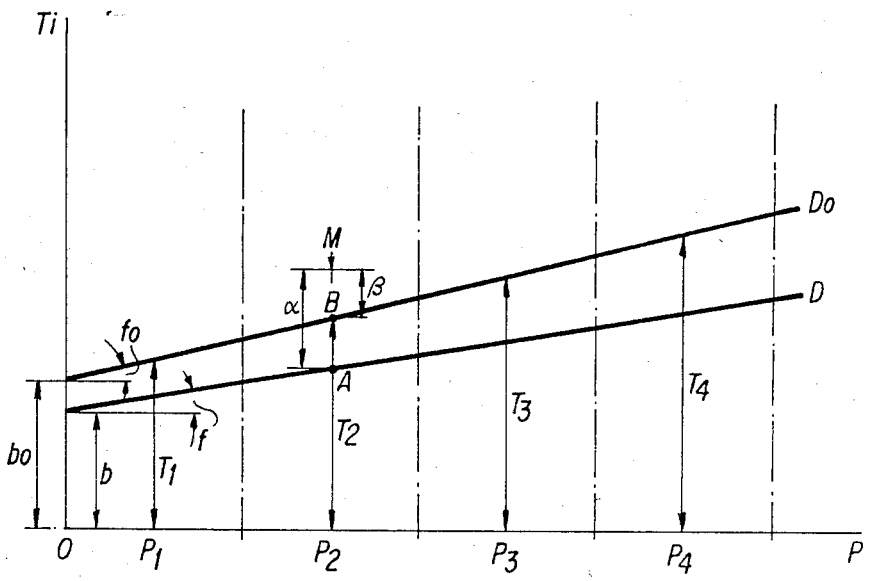
FIG. 1 is a diagram showing the straight control lines in the pressure/time space and FIG. 2 is a flowchart of the process.

Referring now to the drawings, wherein like reference numerals designate identical or corresponding parts throughout the several views, and more particularly to FIG. 1 thereof, wherein the theoretical operating point M is determined from point A of the same abscissa on the existing operating straight line D by a correction term $\alpha$ so that the orginate of N is equal to the ordinate of A multiplied by $(1+\alpha)$. The process known as superinjection comprises further measures to keep the incursion into greater richnesses, from introducing a jerk in the operation of the vehicle, by proportionately alternating the ignition advance momentarily.

Each adaptation cycle therefore determines a theoretical operating point M at abscissa P corresponding to the existing intake pressure. If this point M is on straight control line D, of course no correction is to be made. On the other hand, if the point is outside the straight line, it may be necessary to correct it.

For this purpose, according to the prior art, and particularly according to the American process indicated above, an average pressure threshold is determined. If the existing pressure P is below this threshold, only the ordinate is corrected at the beginning b of straight line D without modifying slope f of this straight line so that it progressively goes through theoretical point M. On the other hand, if this pressure is greater than the threshold, only slope f is corrected without modifying the ordinate at the beginning b so that this straight line progressively goes through new point M. This process therefore is simple but not very precise and is very sensitive to possible local anomalies.

On the contrary, according to the present invention, the space of pressures P is divided into a certain number n of zones, for example four in the example of FIG. 1. For each zone of row j the average pressure $P_j$ corresponding to the abscissa of the center of the zone is defined.

During tuning of the engine, ideal initial control straight line $D_o$ is determined, whose parameters $f_o$ and $b_o$ are loaded in read-only memories. On the other hand, the parameters f and b of the existing control straight line D are loaded in read-write memories and contain values resulting from prior use. In case of default, such as if the read-write memories are erased, these latter are loaded with values $f_o$ and $b_o$.

The adaptation cycles can follow one another in a period that can be relatively short (a fraction of a second) if unity richness is used, and which have the advantage of being more spaced, for example at 10 minutes, if a richness less than unity and the superinjection process are used for the reason indicated above.

Figure 2:
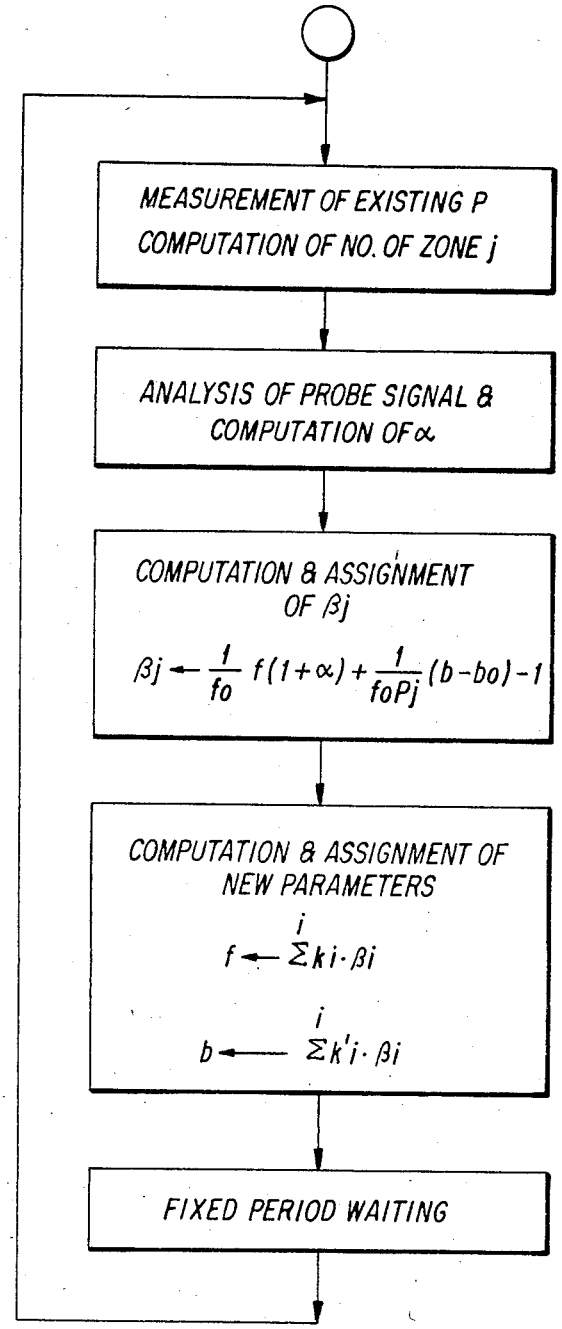

At each new adaptation cycle, shown by the flowchart of FIG. 2, the existing intake pressure P is measured and the number j of the zone in which this pressure is located is determined. For this purpose, a numerical operation is usually performed and it suffices to perform a complete or rounded off division.

After j has been determined, analysis of the probe signal and computation of the correction term $1+\alpha$ in relation to existing control straight line D is performed. This implies in particular, in the case of using a richness less than unity, the application of the superinjection process in its entirety. Starting from point A, an incursion into richness at point M and a return to point A are performed. The ratio of the ordinates of M and A, compared with the set richness, makes it possible to determine $1+\alpha$ directly. These computations are made by merging value P of the pressure with nearest value, for example, P2 in the example of FIG. 1 if j=2.

Moreover, there are available n read-write memories containing various values of $\beta_j$, j varying from 1 to n, the coefficients $\beta$ being defined as coefficients $\alpha$ but from the initial control straight line $D_o$. In other words, a move is made from point B on this straight line to point M by multiplying the ordinates by the factor $1+\beta$.

For the value of j computed at the cycle beginning, there is computed and assigned to memory $\beta_j$ the value indicated in FIG. 2. This value results from a purely linear expression as a function of $\alpha$, since $1/f_o$ and $1/f_oP_j$ are constants, as well as $b_o$, while f and b are existing values in read-write memories of parameters of control straight line D. This purely linear computation therefore is easy and fast. Of course, it affects only $\beta_j$, while the other $\beta_i$, for i different from j, remain at their old value.

With the cycle being continued, there are then computed and assigned to memories f and b also purely linear values expressed as a function of the $\beta_i$, for all values of i from 1 to n, with weighting coefficients $k_i$ and $k'_i$.

These 2n constants $k_i$ and $k'_i$ are naturally contained in read-only memories and are determined experimentally or by computation so that the new straight line D thus determined approaches as closely as possible all the previously computed points such as M.

Control of the injection time continues with the new values of parameters f and b of the straight control line, while the adaptation cycle continues independently in a waiting loop of the set period before restarting at the beginning of the cycle.

During operation of the engine, intake pressure P naturally varies and goes more or less often through all the values of the space provided, which makes it possible successively and periodically to update the various points corresponding to the various zones. But it is clear that each adaptation cycle takes into account not only the operation point M of zone j considered but also all the other points previously computed, i.e., the preceding history. In particular, each new straight line D generally does not go through all the points but consequently attenuates the influence of possible local anomalies.

The computer uses only a few variables: P, j, $\alpha$, f, b, and $\beta_i$ (n values) and a few constants: $1/f_o$, $1/f_oP_j$, $b_o$, $k_i$ (n values), $k'_i$ (n values), richness, and periodicity. Further, computations are extremely simple, since they are all linear and with a small number of terms, and yet precise enough to assure a rapid convergence adapting possibly to a high cycle period.

Naturally, the process applies equally to the stoichiometric mixture or to richnesses different from unity, even variable, as has been seen, and it is always possible to add to it an additional weighting, each time making only a fraction of the computed corrections, or also increasing the coefficients only a unit at a time in the direction computed, in a known way.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. An adaptive process for continuously determining the injection time of an engine as a function of intake pressure or air flow at the intake comprising the steps of:

establishing a straight control line function defined by a slope and a beginning ordinate;

analyzing periodically the exhaust gas of said engine to determine richness differences in said exhaust gases;

dividing the range of possible intake pressures into a number of zones, each of which has assigned a central pressure value at a point in each zone;

measuring the intake pressure and determining the zone into which it falls;

determining in relation to said straight line function a first correction factor as a function of said analyzing and the desired richness;

computing in relation to said straight line function a second correction factor for each zone by a purely linear computation as a function of said first correction factor, said slope and said beginning ordinate;

computing new values of the slope and beginning ordinate by a purely linear formula as a function of constants in read only memory and the values of said second correction factor;

weighting the coefficients used for computing the slope and beginning ordinate during each analysis cycle so that the straight line function approaches the various said points in each zone.

2. A process according to any one of claim 1 further comprising an additional weighting by applying only a part of the correction to each analysis cycle.

3. Process according to claim 1, wherein a unit richness and a short period for the analysis cycle are used.

4. Process according to claim 1, wherein a constant richness less than unity and a relatively high period are used, which are compatible with use of the known process of superinjection for evaluation of the correction term $(1+\alpha)$ in relation to the existing straight line.

* * * * *